US007773910B2

(12) United States Patent
Jeong et al.

(10) Patent No.: US 7,773,910 B2
(45) Date of Patent: Aug. 10, 2010

(54) IMAGE FORMING APPARATUS

(75) Inventors: Yoo-hung Jeong, Suwon-si (KR); Seung-hak Han, Seongnam-si (KR); Dong-ha Choi, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 400 days.

(21) Appl. No.: 11/968,968

(22) Filed: Jan. 3, 2008

(65) Prior Publication Data

US 2008/0157639 A1 Jul. 3, 2008

(30) Foreign Application Priority Data

Jan. 3, 2007 (KR) ..... 10-2007-0000696
Apr. 23, 2007 (KR) ..... 10-2007-0039254

(51) Int. Cl.
*G03G 15/00* (2006.01)

(52) U.S. Cl. ..... 399/107

(58) Field of Classification Search ..... 399/107, 399/124, 125; 312/237
See application file for complete search history.

(56) References Cited

U.S. PATENT DOCUMENTS 5,168,308 A * 12/1992 Hiraike et al. ..... 399/125
5,966,569 A * 10/1999 Haneda ..... 399/121
7,133,626 B2 * 11/2006 Kaiga et al. ..... 399/110
2006/0029424 A1 * 2/2006 Kawai et al. ..... 399/125
2006/0088336 A1 4/2006 Hirose et al.
2006/0120756 A1 * 6/2006 Ahn et al. ..... 399/124

FOREIGN PATENT DOCUMENTS

EP 0384467 2/1990
JP 2006-119474 5/2006

OTHER PUBLICATIONS

Office Action issued in corresponding European Patent Application No. 08100039.0 dated Aug. 18, 2008.

* cited by examiner

*Primary Examiner*—David P Porta
*Assistant Examiner*—Kiho Kim
(74) *Attorney, Agent, or Firm*—Staas & Halsey LLP

(57) ABSTRACT

An image forming apparatus including: a first body; a second body to pivot between a closed position and an open position in relation to the first body; a guide lever member to control a pivoting of the second body and having a first end connected to one of the first body and the second body, and a second end, opposite the first end; and a guide rail member including: a guide rail along which the second end of the guide lever member is slidably connected. The guide rail member includes a first pressing portion to constrain the second end of the guide lever member in the open position of the second body, and a second pressing portion to prevent the second body from abruptly closing while the second body is being closed.

27 Claims, 6 Drawing Sheets

IMAGE FORMING APPARATUS

CROSS-REFERENCE TO RELATED APPLICATIONS

This application claims the benefit of Korean Application Nos. 2007-696, filed Jan. 3, 2007, and 2007-39254, filed Apr. 23, 2007, in the Korean Intellectual Property Office, the disclosures of which are incorporated herein by reference.

BACKGROUND OF THE INVENTION

1. Field of the Invention

Aspects of the present invention relate to an image forming apparatus, and more particularly, to an image forming apparatus with an improved opening and closing structure.

2. Description of the Related Art

In general, an image forming apparatus (such as a printer, a photocopier, and a facsimile machine) has a cover that opens and closes an upper portion of a body in order to facilitate repair/maintenance of the components provided in the body and/or to remove paper jammed in a paper conveyance path. Such an image forming apparatus requires an opening and closing apparatus to maintain the cover in an open state and a closed state.

A conventional opening and closing apparatus for maintaining a cover in an open state and a closed state is disclosed in Japanese Patent Publication Nos. H8-143054 and H10-98278. However, the opening and closing apparatus disclosed in Japanese Patent Publication Nos. H8-143054 and H10-9872 only has a cover function and is inefficient if the cover is heavy. However, if the cover is provided with an additional device (such as a scanner or an automatic document feeder (ADF)) that adds weight to the cover, there is a problem in maintaining the cover in the open state. As a result, the cover abruptly closes causing damage to the body.

Japanese Patent Publication No. 2006-119474 discloses an image forming apparatus that, despite including a heavy cover unit, is capable of maintaining the cover unit in an open state. The image forming apparatus disclosed in Japanese Patent Publication No. 2006-119474 includes a locking member provided at either an image forming unit or an image reading unit, and a link member having one end supported by the other unit and the other end engaged with the locking member when the image reading unit is in an open state. The link member links both of the units in the open state.

However, the image forming apparatus disclosed in Japanese Publication No. 2006-119474 must include an extension coil spring in order to elastically support the other end of the link member and maintain the link member in an open state. That is, in the absence of the extension coil spring, the upstanding state of the link member is unstable and thus a cover unit is likely to abruptly close during work (such as repair/maintenance or jammed paper removal). In this case, damage to the body and/or injuries to a user's fingers result.

SUMMARY OF THE INVENTION

Aspects of the present invention provide an image forming apparatus having a simplified structure and stably maintaining a body in an open state during repair/maintenance work, thereby providing a user with a convenience.

According to an aspect of the present invention, there is provided an image forming apparatus including: a first body to perform an image forming operation on a print medium; a second body to pivot between a closed position and an open position in relation to the first body; a guide lever member to control a pivoting of the second body, the guide lever member having a first end connected to one of the first body and the second body, and a second end, opposite the first end; and a guide rail member including: a guide rail along which the second end of the guide lever member is connected to slide between a first end of the guide rail corresponding to the open position of the second body and a second end of the guide rail corresponding to the closed position of the second body, a first pressing portion to constrain the second end of the guide lever member in the first end of the guide rail when the second body is in the open position, and a second pressing portion to prevent the second body from abruptly pivoting from the open position to the closed position.

The first and the second bodies may have the same widths and lengths, the second body may be provided with a laser scanning unit, and the first body may be provided with image forming units that are arranged to form a C-shaped print medium path.

The image forming units may include a feeding unit, a developing unit, a transfer unit, a fusing unit, and/or a paper discharge unit.

A scanner unit may further be provided on the second body.

The guide rail member may be provided on the first body.

The guide lever member may be connected to the second body.

The first pressing portion may include a first elastic bending portion provided on the first side of the guide rail and upwardly bending, and a first elastic space under the first elastic bending portion.

A first elastic member may be provided in the first elastic space to elastically support the first elastic bending portion.

The second pressing portion may include a second elastic bending portion provided on the second side of the guide rail and upwardly bending, and a second elastic space under the second elastic bending portion.

A second elastic member may be provided in the second elastic space to elastically support the second elastic bending portion.

The first pressing portion and the second pressing portion may have different heights, and the height of the second pressing portion may be greater than the height of the first pressing portion.

A C-shaped recess may be formed on the first end of the guide lever member to be hooked over a shaft provided on the second body.

A protrusion may be provided on the second end of the guide lever member to be prevented from being released from the guide rail.

An open angle of the second body with respect to the first body may range from 40° to about 80°.

According to another aspect of the present invention, there is provided an image forming apparatus comprising: a first body; a second body to pivot between a closed position and an open position in relation to the first body; a plurality of guide lever members to control a pivoting of the second body, each guide lever member having a first end connected to one of the first body and the second body, and a second end, opposite the first end; and a plurality of guide rail members, each corresponding to one guide lever member comprising: a guide rail along which the second end of the corresponding guide lever member is slidably connected. The guide rail member includes a guide rail having a first pressing portion to constrain the second end of the guide lever member in the open state of the second body, and a second pressing portion to prevent the second body from abruptly closing while the second body is being closed.

Three or more pressing portions may be provided, according to the weight of the second body.

According to yet another aspect of the present invention, there is provided an image forming apparatus including: a first body to perform an image forming operation on a print medium; a second body to pivot between a closed position and an open position in relation to the first body; a guide lever member to control a pivoting of the second body, the guide lever member having a first end connected to one of the first body and the second body, and a second end, opposite the first end; and a guide rail member including: a guide rail along which the second end of the guide lever member is connected to slide between a first end of the guide rail corresponding to the open position of the second body and a second end of the guide rail corresponding to the closed position of the second body, and a first pressing portion to constrain the second end of the guide lever member in the first end of the guide rail when the second body is in the open position.

According to yet another aspect of the present invention, there is provided an image forming apparatus including: a first body to perform an image forming operation on a print medium; a second body to pivot between a closed position and an open position in relation to the first body; and an opening/closing unit to guide the second body to be open and closed in relation to the first body, wherein the opening/closing unit includes: a guide lever member to control a pivoting of the second body, the guide lever member having a first end connected to one of the first body and the second body, and a second end, opposite the first end; and a guide rail member to be formed in the other one of the first body and the second body, and to be movably connected to the second end of the guide lever member, the guide rail member comprising a pressing portion to constrain the second body, the pressing portion putting pressure in a direction different from the movement of the guide lever member.

In the guide lever member, force generated by the weight of the second body may be almost opposite to the direction of the pressure of the pressing portion.

The pressing portion may press a plurality of areas.

The pressing portion may press an area around a first end and a second end of an area in which the guide lever member moves.

A number of the pressing portion may be plural, and the plurality of pressing portions may have different pressure.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1A:
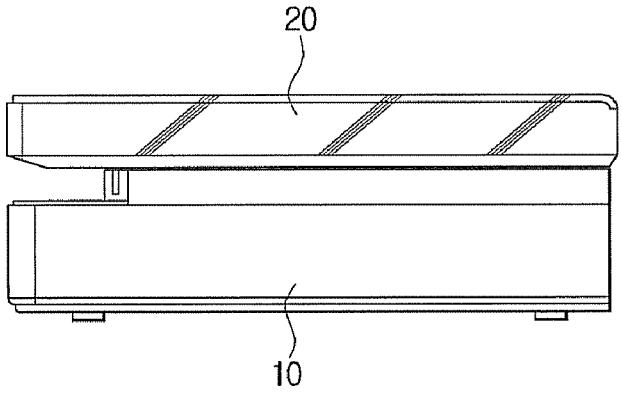
FIGS. 1A and 1B are schematic views illustrating an image forming apparatus in a closed state and an open state according to an embodiment of the present invention.
Figure 1B:
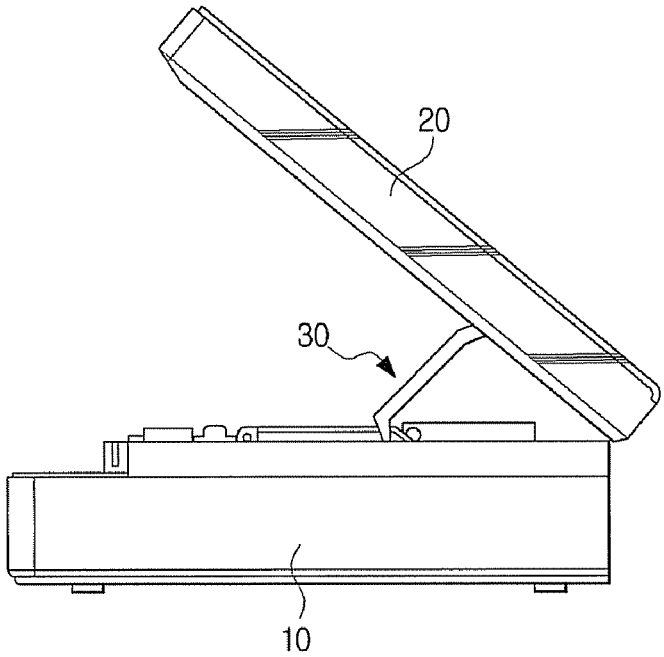

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Referring to FIGS. 1A through 3, an image forming apparatus according to an embodiment of the present invention includes a first body 10, a second body 20 to pivot open and closed in relation to the first body 10, and an opening and closing apparatus 30 to guide opening and closing operations of the second body 20 with respect to the first body 10.

The first body 10 and the second body 20 are connected to each other by a hinge unit 40 so that the second body 20 is configured to pivot from the first body 10. The opening and closing apparatus 30 guides opening and closing operations of the second body 20 from a position different from that of the hinge unit 40.

The first body 10 and the second body 20 may have equal or almost equal widths and/or lengths. Furthermore, a top surface of the second body 20 may be flat. The first body 10 includes a printing unit (i.e., components used to form an image, such as a print medium feeding unit 11, a developing unit 12, a transfer unit 13, a fusing unit 14, and a print medium discharge unit 15). These components may be arranged to form a C-shaped paper path. Furthermore, the second body 20 includes a laser scanning unit 21 and a scanner unit 22. The print medium supplied by the print medium feeding unit 11 may be any medium on which an image may be formed (such as paper or transparencies)

Figure 2:
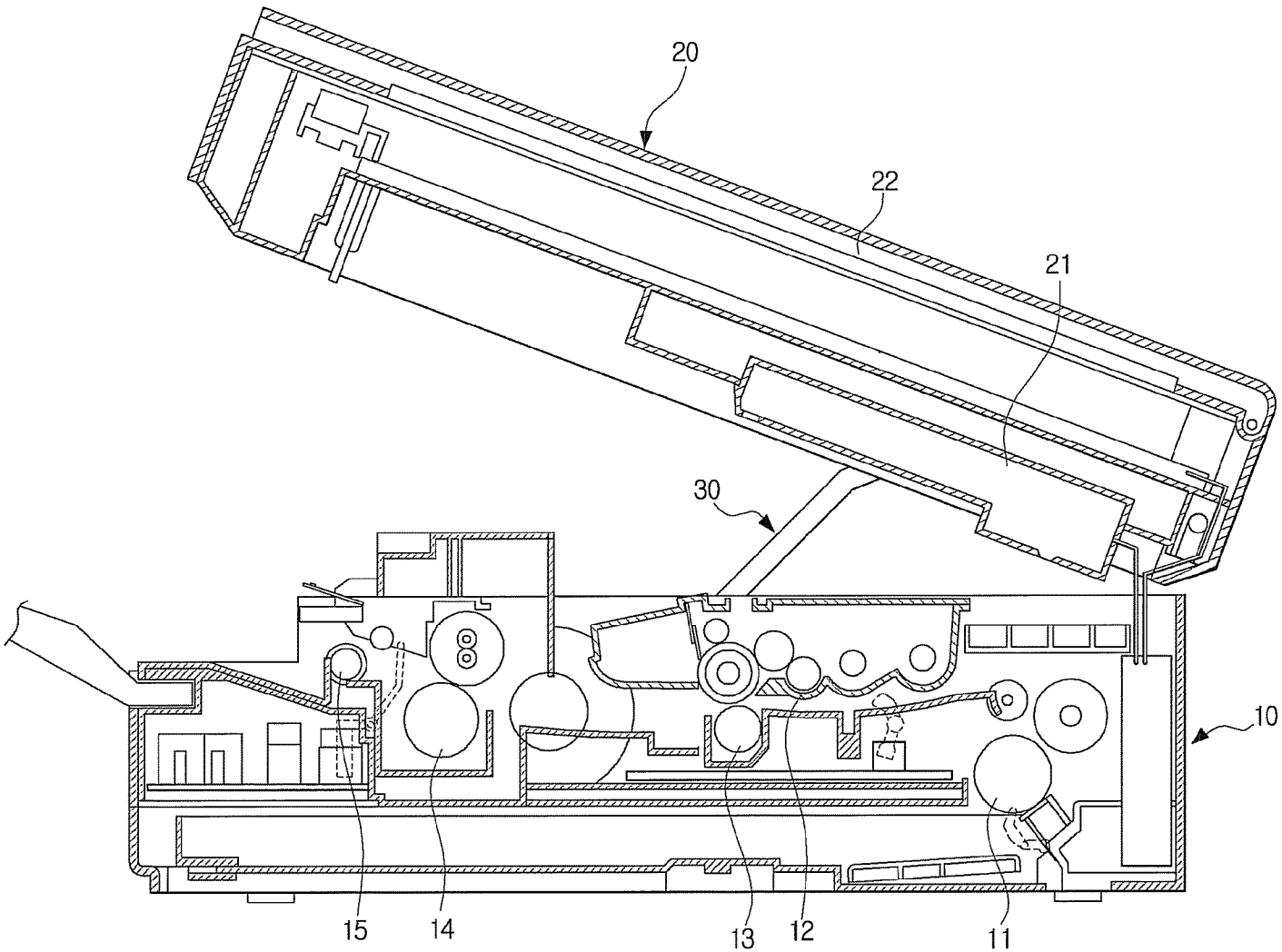
FIG. 2 is a side section view illustrating the image forming apparatus of FIGS. 1A and 1B.
Figure 3:
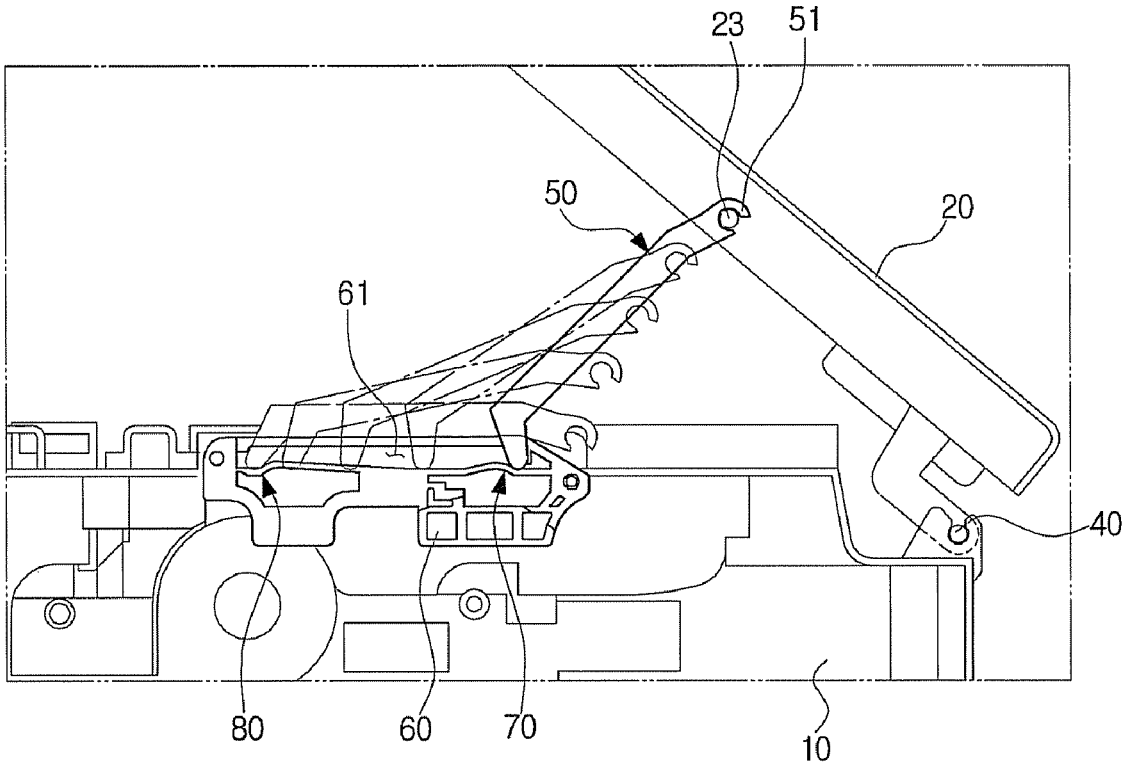
FIG. 3 is a view illustrating the structure and operation of an opening and closing apparatus according to an embodiment of the present invention.
Figure 4:
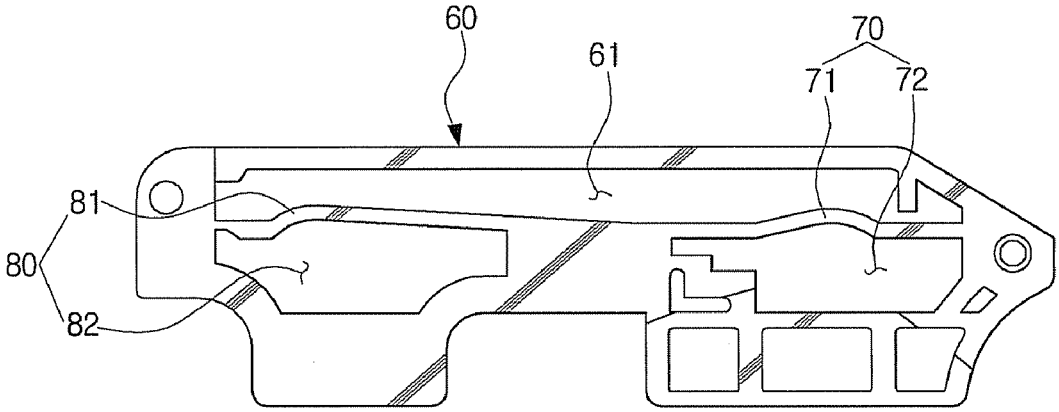
FIG. 4 is a view illustrating a guide rail member configuring the opening and closing apparatus according to an embodiment of the present invention.
Figure 5:
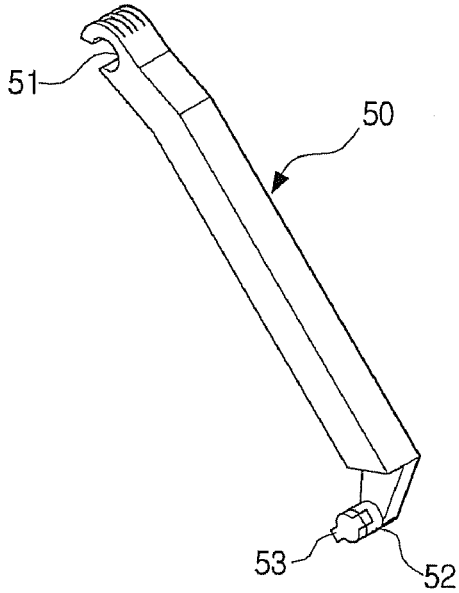
FIG. 5 is a view illustrating a guide lever member configuring the opening and closing apparatus according to an embodiment of the present invention.
Figure 6:
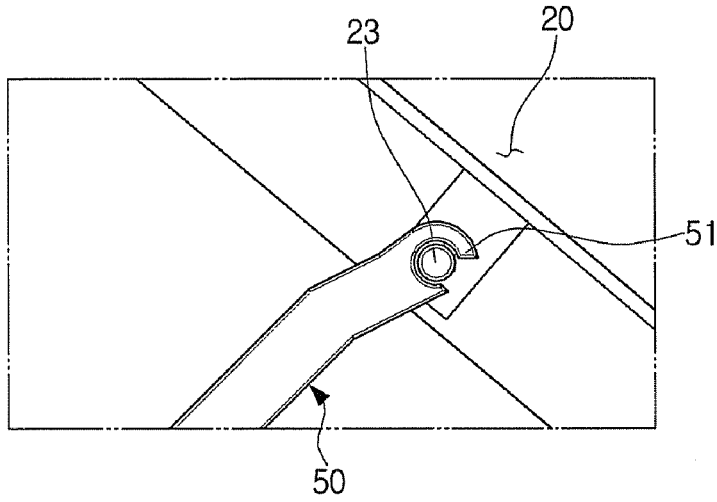
FIG. 6 is a view illustrating a linkage of the guide lever member of FIG. 5.

As shown in FIG. 2, the second body 20 is provided to pivot on the hinge unit 40 and open the first body 10 in order to, for example, facilitate repair/maintenance work for the components in the first body 10 and/or the second body 20 or removal of jammed paper. The opening and closing apparatus 30 guides the opening and closing operations of the second body 20.

Specifically, the opening and closing apparatus 30 prevents the second body 20 from excessively rotating, and maintains the second body 20 in an open state at a predetermined angle. Furthermore, the opening and closing apparatus 30 prevents the second body 20 from abruptly closing due to the weight of the second body 10. The second body 20 may, although not necessarily, open with respect to the first body 10 at an angle ranging from 40° to 80°.

As shown in FIGS. 3 through 6, the opening and closing apparatus 30 includes a guide lever member 50 having one end connected to the second body 20 and a guide rail member 60 provided on the first body 10.

The guide lever member 50 has a C-shaped recess 51 on a first end thereof. The recess 51 is hooked over a shaft 23 provided on the second body 20 in order to connect to the second body 20. Furthermore, the guide lever member 50 has a moving shaft 52 (to be described later) provided on a second end, opposite the first end, to connect to the guide rail member 60. Furthermore, the guide lever member 50 has an end portion on which a release preventing protrusion 53 is provided. It is understood that other methods and devices may be used to connect the guide lever member 50 to the second body 20 and the guide rail member 60.

The guide rail member 60 is connected to a side surface of the first body 10 by a fastening element (such as a screw). The guide rail member 60 is provided with a guide rail 61 into which the moving shaft 52 of the guide lever member 50 is inserted. Accordingly, the moving shaft 52 slides along the guide rail 61. The guide rail 61 includes a first pressing portion 70 and a second pressing portion 80. When the moving shaft 52 of the guide lever member 50 is inserted into the guide rail 61, the moving shaft 52 is prevented from releasing from the guide rail 61 because the release preventing protrusion 53 has a larger width than that of the guide rail 61.

The first pressing portion 70 constrains the second end portion of the guide lever member 50 in a set position. That is, the first pressing portion 70 restricts the moving shaft 52 from moving when the second body 20 is opened by a user, thereby maintaining the open state of the second body 20. The first pressing portion 70 includes a first elastic bending portion 71 and a first elastic space 72 provided under the first elastic bending portion 71.

More specifically, when the second body 20 is opened by a user, the moving shaft 52 of the guide lever member 50 slides from an initial position toward the first pressing portion 70 along the guide rail 61. When the second body 20 is completely opened, the moving shaft 52 moves over the first pressing portion 70. If an external force applied by the user is removed while the second body is completely opened (i.e., in the open state), a force generated due to a weight of the second body 20 is exerted on the guide rail member 50. Since the moving shaft 52 of the guide lever member 50 is supported in the first pressing portion 70 and the elasticity of the first pressing portion 70 is set to be greater than the force generated by the weight of the second body 20, the second body 20 remains in the open state unless an additional external force is applied.

The second pressing portion 80 prevents the second body 20 from abruptly closing due to the weight of the second body 20. The second body 20 includes a second elastic bending portion 81 and a second elastic space 82 provided under the second elastic bending portion 81. More specifically, when an external force is applied to the second body 20 when the second body 20 is in the open state (described above), the moving shaft 52 of the guide lever member 50 that is supported in the first pressing portion 70 overcomes the elasticity of the first pressing portion 70 and slides toward the second pressing portion 80 along the guide rail 61. Since the second pressing portion 80 is elastically supported in an opposite direction to the direction in which the moving shaft 52 moves, the moving shaft 52 moves gradually, overcoming the elasticity of the second pressing portion 80. Accordingly, the second body 20 closes gradually. If the moving shaft 52 goes over the second pressing portion 20 and moves back to the initial location (i.e., the closed state), the second pressing portion 80 elastically supports the moving shaft 52 at the initial location. Accordingly, the second body 20 is not raised or opened unless an additional external force is applied.

Due to the first pressing portion 70 and the second pressing portion 80 provided on the guide rail 61, the guide lever member 50 is regulated between at least two locations and the second body 20 is prevented from being closed from a weight of the second body 20. The conventional apparatus disclosed in Japanese Patent Publication No. 2006-119474 requires an extension coil spring to achieve the above-described effect. However, aspects of the present invention can achieve the effect without an additional member such as a spring.

In the image forming apparatus according to an embodiment of the present invention, the direction of an external force applied to the guide lever member 50 is different from the sliding direction of the guide lever member 50, so when excessive force is not required to open or close the second pressing portion 20. In other words, in a conventional image forming apparatus, excessive force overcoming the elasticity at sliding is necessary to open or close a cover, whereas in the present invention, the direction of an external force and the sliding direction are different, so excessive force is not necessary.

The first pressing portion 70 and the second pressing portion 80 may be provided such that a height of the first pressing portion 70 is different from a height of the second pressing portion 80. Specifically, the second pressing portion 80 may be provided higher than the first pressing portion 70, such that the second body 20 opens and closes more smoothly.

Figure 7:
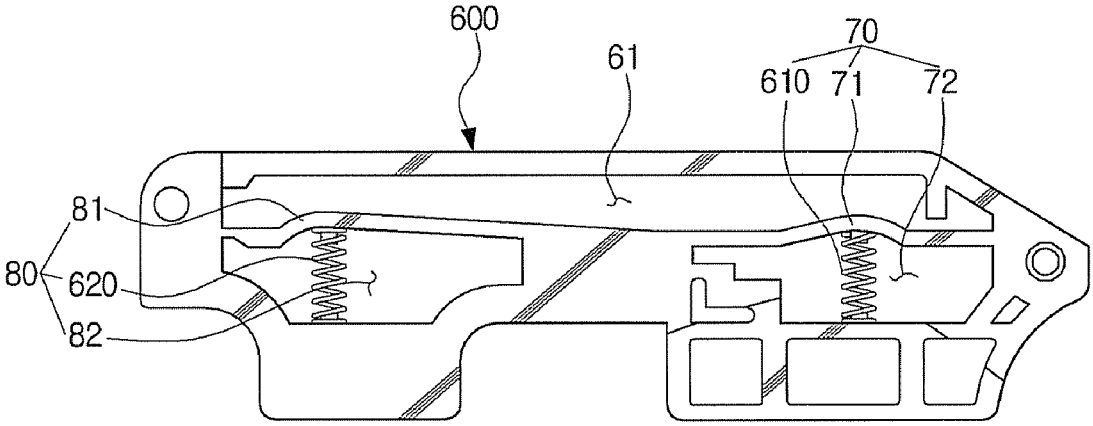
FIG. 7 is a view illustrating a guide rail member according to another embodiment of the present invention.

FIG. 7 illustrates a guide rail member 600 of the opening and closing apparatus according to another embodiment of the present invention. As shown in FIG. 7, the guide rail member 600 has the same components as that of the guide rail member 60 described above with reference to FIGS. 3 through 6. However, the guide rail member 600 additionally includes a first elastic member 610 and a second elastic member 620 provided in a first elastic space 72 and a second elastic space 82, respectively.

The first elastic member 610 and the second elastic member 620 are provided in the first elastic space 72 and the second elastic space 82 to support the elasticity of the first elastic bending portion 71 and the second elastic bending portion 81. That is, the elastic bending portions 71 and 81 are subject to the elasticity of the first and the second elastic members 610 and 620 in addition to their own elasticity so that the guide lever member 50 can be constrained in a set position and the damping effect of the second pressing portion 80 can be improved. These effects are applied more effectively in the case that the weight of the second body 20 is large.

Figure 8:
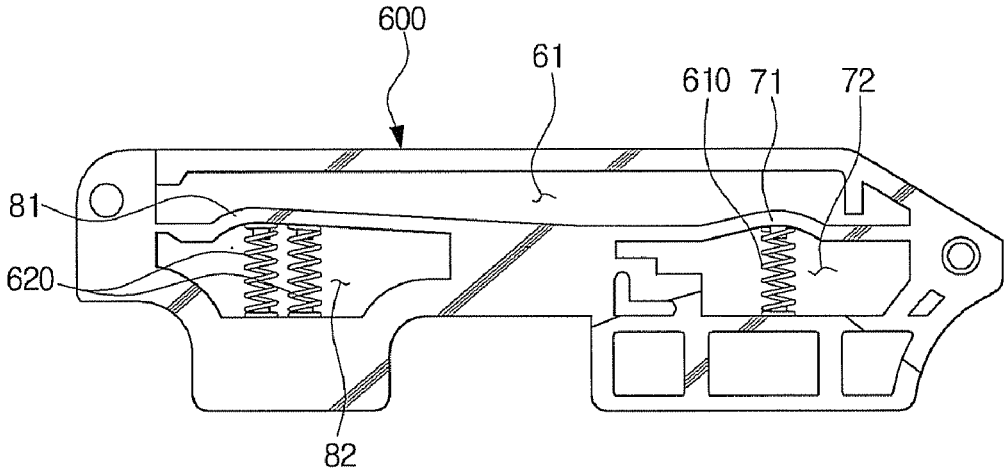
FIG. 8 is a view illustrating a guide rail member according to yet another embodiment of the present invention.

FIG. 8 illustrates one or more first elastic members 610 and second elastic members 620 according to another embodiment of the present invention. Any number of elastic members 610 and 620 may be provided on a guide rail member 600 according to aspects of the present invention. For example, the number of elastic members 610 and 620 may be provided according to the weight of the second body 20 (i.e., a higher number of elastic members 610 and 620 for higher weights of the second body 20).

Although not illustrated, it is understood that the opening and closing apparatus 30 according to aspects of the present invention may include three or more pressing portions according to, for example, the weight of the second body 20. For example, a third pressing portion may be located between the first pressing portion 70 and the second pressing portion 80 described above to serve as a damper for the second body 20 at two stages even if the second body 20 is heavy, thereby preventing the second body 20 from abruptly closing.

Figure 9:
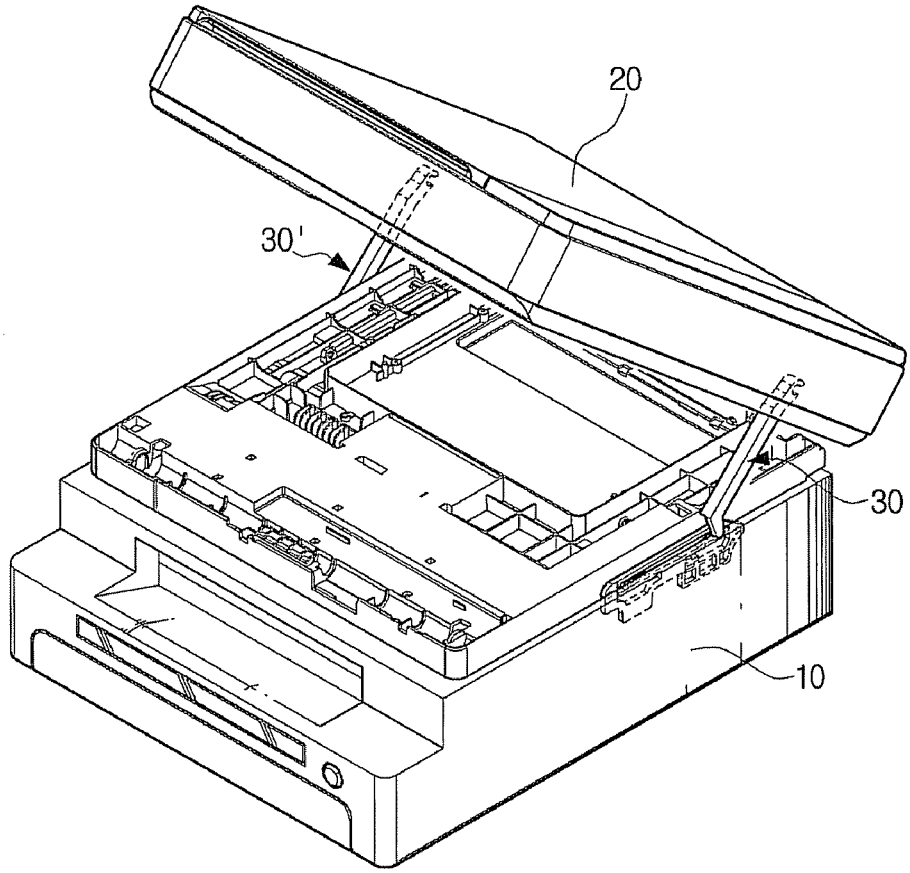
FIG. 9 is a schematic view illustrating an image forming apparatus according to another embodiment of the present invention.

FIG. 9 is a schematic view illustrating an image forming apparatus according to another embodiment of the present invention. The image forming apparatus shown in FIG. 9 is similar to the image forming apparatus described above with reference to FIGS. 1 through 8. However, the image forming apparatus illustrated in FIG. 9 includes two opening and closing apparatuses 30 and 30' provided on both side surfaces of the first body 10 and the second body 10. Thus, detailed descriptions thereof will be omitted.

The opening and closing apparatuses 30 and 30' are provided on both sides of the image forming apparatus to provide balanced supporting forces for the second body 20 so that the second body 20 is more stably maintained in the open state. Also, the closing operation of the second body 20 is more smoothly and more stably performed. It is understood that more than two opening and closing apparatuses 30 and 30' may be provided according to other aspects of the present invention.

Although the above embodiments illustrate the guide rail member 60 provided on the first body 10 and the guide lever member 50 provided on the second body 20, aspects of the present invention are not limited thereto. For example, the guide lever member 50 may be provided on the first body 10 and the guide rail member 60 may be provided on the second body 20.

As described above, according to aspects of the present invention, even if the second body 20 (which corresponds to a cover unit of a general image forming apparatus) is further provided with a scanner unit, ADF, and/or a laser scanning unit that increase the weight of the second body 20, the second body 20 can be more stably and firmly maintained in the open state.

Also, since the second body 20 is prevent from abruptly closing, a shock that may be caused by an abrupt closing and subsequent damages to the components can be prevented. Also, user's fingers can be prevented from being jammed between the first body 10 and the second body 20.

Moreover, by providing the guide rail member 60 and the guide lever member 50, an image forming apparatus can be manufactured at a more cost effective price, yet still have a wide range of utilization.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An image forming apparatus comprising:

a first body to perform an image forming operation on a print medium;

a second body to pivot between a closed position and an open position in relation to the first body;

a guide lever member to control a pivoting of the second body, the guide lever member having a first end connected to one of the first body and the second body, and a second end, opposite the first end; and a guide rail member comprising:

a guide rail along which the second end of the guide lever member is connected to slide between a first end of the guide rail corresponding to the open position of the second body and a second end of the guide rail corresponding to the closed position of the second body, a first pressing portion to constrain the second end of the guide lever member in the first end of the guide rail when the second body is in the open position, and a second pressing portion to prevent the second body from abruptly pivoting from the open position to the closed position.

2. The apparatus as claimed in claim 1, wherein a width of the first body is equal to a width of the second body and/or a length of the first body is equal to a length of the second body.

3. The apparatus as claimed in claim 1, wherein the second body comprises a laser scanning unit and the first body comprises:

a developing unit to perform the image forming operation on the print medium, a feeding unit to stack print media and to feed the print medium toward the developing unit, and a discharging unit to discharge the print medium after the image forming operation performed thereon is completed; and the feeding unit, the developing unit, and the discharging unit are arranged to form a C-shaped print medium path.

4. The apparatus as claimed in claim 3, wherein:

the first pressing portion comprises:

a first elastic bending portion to upwardly bend the first pressing portion at a position adjacent to the first end of the guide rail so as to constrain the second end of the guide lever member in the first end of the guide rail when the second body is in the open position, and a first space under the first elastic bending portion to enable the first elastic bending portion to move thereinto when the second body pivots from the open position to the closed position and when the second body pivots from the closed position to the open position; and the second pressing portion comprises:

a second elastic bending portion to upwardly bend the second pressing portion at a position adjacent to the second end of the guide rail so as to prevent the second end of the guide lever member from abruptly sliding to the second end of the guide rail, and a second space under the second elastic bending portion to enable the second elastic bending portion to move thereinto when the second body pivots from the open position to the closed position and when the second body pivots from the closed position to the open position.

5. The apparatus as claimed in claim 4, further comprising:

at least one first elastic member provided in the first space to elastically support the first elastic bending portion; and at least one second elastic member provided in the second space to elastically support the second elastic bending portion.

6. The apparatus as claimed in claim 1, wherein the second body comprises a scanner unit to scan a document.

7. The apparatus as claimed in claim 1, wherein the first end of the guide lever member is connected to the second body, and the guide rail member is provided on the first body.

8. The apparatus as claimed in claim 1, wherein the first end of the guide lever member is connected to the first body, and the guide rail member is provided on the second body.

9. The apparatus as claimed in claim 1, wherein a height of the first pressing portion is different from a height of the second pressing portion.

10. The apparatus as claimed in claim 1, wherein the first pressing portion comprises:

a first elastic bending portion to upwardly bend the first pressing portion at a position adjacent to the first end of the guide rail so as to constrain the second end of the guide lever member in the first end of the guide rail when the second body is in the open position; and a first space under the first elastic bending portion to enable the first elastic bending portion to move thereinto when the second body pivots from the open position to the closed position and when the second body pivots from the closed position to the open position.

11. The apparatus as claimed in claim 10, wherein the first pressing portion further comprises a first elastic member provided in the first space to elastically support the first elastic bending portion.

12. The apparatus as claimed in claim 1, wherein the second pressing portion comprises:

a second elastic bending portion to upwardly bend the second pressing portion at a position adjacent to the second end of the guide rail so as to prevent the second end of the guide lever member from abruptly sliding to the second end of the guide rail; and a second space under the second elastic bending portion to enable the second elastic bending portion to move thereinto when the second body pivots from the open position to the closed position and when the second body pivots from the closed position to the open position.

13. The apparatus as claimed in claim 12, wherein the second pressing portion further comprises a second elastic member provided in the second space to elastically support the second elastic bending portion.

14. The apparatus as claimed in claim 1, wherein the guide lever member comprises a protrusion on the second end of the guide lever member to prevent the guide lever member from being released from the guide rail.

15. The apparatus as claimed in claim 1, wherein the guide lever member comprises a C-shaped recess on the first end of the guide lever member to be hooked over a shaft provided on the one of the first body and the second body.

16. The apparatus as claimed in claim 1, wherein the open position corresponds to an angle of approximately 40° to 80° between the first body and the second body.

17. An image forming apparatus comprising:

a first body to perform an image forming operation on a print medium;

a second body to pivot between a closed position and an open position in relation to the first body;

a plurality of guide lever members to control a pivoting of the second body, each guide lever member having a first end connected to one of the first body and the second body, and a second end, opposite the first end; and a plurality of guide rail members, each guide rail member corresponding to one guide lever member and comprising:

a guide rail along which the second end of the corresponding guide lever member is connected to slide between a first end of the guide rail corresponding to the open position of the second body and a second end of the guide rail corresponding to the closed position of the second body, a first pressing portion to constrain the second end of the corresponding guide lever member in the first end of the guide rail when the second body is in the open position, and a second pressing portion to prevent the second body from abruptly pivoting from the open position to the closed position.

18. The apparatus as claimed in claim 17, wherein the first end of each guide lever member is connected to the second body, and the plurality of guide rail members is provided on the first body.

19. The apparatus as claimed in claim 17, wherein:

the first pressing portion of each guide rail member comprises:

a first elastic bending portion to upwardly bend the first pressing portion at a position adjacent to the first end of the guide rail so as to constrain the second end of the guide lever member in the first end of the guide rail when the second body is in the open position, and a first space under the first elastic bending portion to enable the first elastic bending portion to move thereinto when the second body pivots from the open position to the closed position and when the second body pivots from the closed position to the open position; and the second pressing portion of each guide rail member comprises:

a second elastic bending portion to upwardly bend the second pressing portion at a position adjacent to the second end of the guide rail so as to prevent the second end of the guide lever member from abruptly sliding to the second end of the guide rail, and a second space under the second elastic bending portion to enable the second elastic bending portion to move thereinto when the second body pivots from the open position to the closed position and when the second body pivots from the closed position to the open position.

20. The apparatus as claimed in claim 19, further comprising:

at least one first elastic member provided in each first space to elastically support the first elastic bending portion; and at least one second elastic member provided in each second space to elastically support the second elastic bending portion.

21. The apparatus as claimed in claim 17, wherein the open position corresponds to an angle of approximately 40° to 80° between the first body and the second body.

22. An image forming apparatus comprising:

a first body to perform an image forming operation on a print medium;

a second body to pivot between a closed position and an open position in relation to the first body;

a guide lever member to control a pivoting of the second body, the guide lever member having a first end connected to one of the first body and the second body, and a second end, opposite the first end; and a guide rail member comprising:

a guide rail along which the second end of the guide lever member is connected to slide between a first end of the guide rail corresponding to the open position of the second body and a second end of the guide rail corresponding to the closed position of the second body, and a first pressing portion to constrain the second end of the guide lever member in the first end of the guide rail when the second body is in the open position.

23. An image forming apparatus comprising:

a first body to perform an image forming operation on a print medium;

a second body to pivot between a closed position and an open position in relation to the first body; and an opening/closing unit to guide the second body to be open and closed in relation to the first body, wherein the opening/closing unit comprises:

a guide lever member to control a pivoting of the second body, the guide lever member having a first end connected to one of the first body and the second body, and a second end, opposite the first end; and a guide rail member to be formed in the other one of the first body and the second body, and to be movably connected to the second end of the guide lever member, the guide rail member comprising a pressing portion to constrain the second body, the pressing portion putting pressure in a direction different from the movement of the guide lever member.

24. The apparatus as claimed in claim 23, wherein in the guide lever member, force generated by the weight of the second body is almost opposite to the direction of the pressure of the pressing portion.

25. The apparatus as claimed in claim 23, wherein the pressing portion presses a plurality of areas.

26. The apparatus as claimed in claim 23, wherein the pressing portion presses an area around a first end and a second end of an area in which the guide lever member moves.

27. The apparatus as claimed in claim 23, wherein a number of the pressing portion is plural, and the plurality of pressing portions have different pressure.

* * * * *